US006074012A

United States Patent [19]

Wu

[11] Patent Number: 6,074,012

[45] Date of Patent: Jun. 13, 2000

[54] ADJUSTABLE ARMREST DEVICE

[76] Inventor: Yao Chuan Wu, 58, Ma Yuan West St., Taichung, Taiwan

[21] Appl. No.: 09/282,031

[22] Filed: Mar. 30, 1999

[51] Int. Cl.[7] ..... A47C 7/54

[52] U.S. Cl. ..... 297/411.26; 297/411.31; 297/411.35; 297/411.37

[58] Field of Search ..... 297/411.26, 411.31, 297/411.32, 411.33, 411.35, 411.37, 411.38

[56] References Cited

U.S. PATENT DOCUMENTS

| | | | |
|---|---|---|---|
| 5,380,065 | 1/1995 | Rohrer | 297/411.35 X |
| 5,407,249 | 4/1995 | Bonutti | 297/411.35 |
| 5,439,268 | 8/1995 | Dozsa-Farkas | 297/411.35 |
| 5,590,934 | 1/1997 | Gibbs | 297/411.35 X |
| 5,641,203 | 6/1997 | Van De Riet et al. | 297/411.37 |
| 5,651,586 | 7/1997 | Groth | 297/411.31 X |
| 5,655,814 | 8/1997 | Gibbs | 297/411.37 X |
| 5,749,628 | 5/1998 | Snyder et al. | 297/411.31 X |
| 5,876,097 | 3/1999 | Cao | 297/411.35 X |
| 5,884,975 | 3/1999 | Su | 297/411.35 |
| 5,884,976 | 3/1999 | Breen et al. | 297/411.35 X |
| 5,927,811 | 7/1999 | Tseng | 297/411.31 |

*Primary Examiner*—Peter M. Cuomo
*Assistant Examiner*—Rodney B. White
*Attorney, Agent, or Firm*—Alan Kamrath; Oppenheimer Wolff & Donnelly LLC

[57] ABSTRACT

An adjustable armrest device has an armrest seat, a slide seat disposed on the armrest seat, and a pivot connection seat disposed on the slide seat. A disk is inserted in a center hole of the pivot connection seat. Two screw rods are disposed on the slide seat and inserted in two through holes of the disk. The pivot connection seat is disposed on an armrest holder stably. A pad is disposed on the armrest seat. A pivot post is inserted through the pad and inserted in the circular hole.

3 Claims, 6 Drawing Sheets

ADJUSTABLE ARMREST DEVICE

BACKGROUND OF THE INVENTION

The present invention relates to an adjustable armrest device. More particularly, the present invention relates to an adjustable armrest device for a chair or for a sofa.

A height of a conventional armrest can be adjusted. However, the conventional armrest cannot be rotated according to a rotating direction of an arm of a user. Therefore, the user should lift the arm upward while the arm is moved.

SUMMARY OF THE INVENTION

An object of the present invention is to provide an adjustable armrest device which can be adjusted easily.

Another object of the present invention is to provide an adjustable armrest device which has a disk inserted in a pivot connection seat to engage with a slide seat in order to provide a rotation function.

Another object of the present invention is to provide an adjustable armrest device which has a slide seat disposed between an armrest seat and a pivot connection seat in order to provide a displacement function.

Accordingly, an adjustable armrest device comprises an armrest seat, a slide seat disposed on the armrest seat, and a pivot connection seat disposed on the slide seat. The armrest seat has a recess portion, a circular hole, a center bar, and two rails. A plurality of recess holes are formed on the center bar. A blocking plate is fastened on the armrest seat. The slide seat has two guide grooves engaging with the rails. A plurality of blind holes are formed on the slide seat. The pivot connection seat has a center hole. A disk is inserted in the center hole of the pivot connection seat. The disk has two through holes. Two screw rods are disposed on the slide seat and inserted in the through holes of the disk.

DETAILED DESCRIPTION OF THE INVENTION

Figure 1:
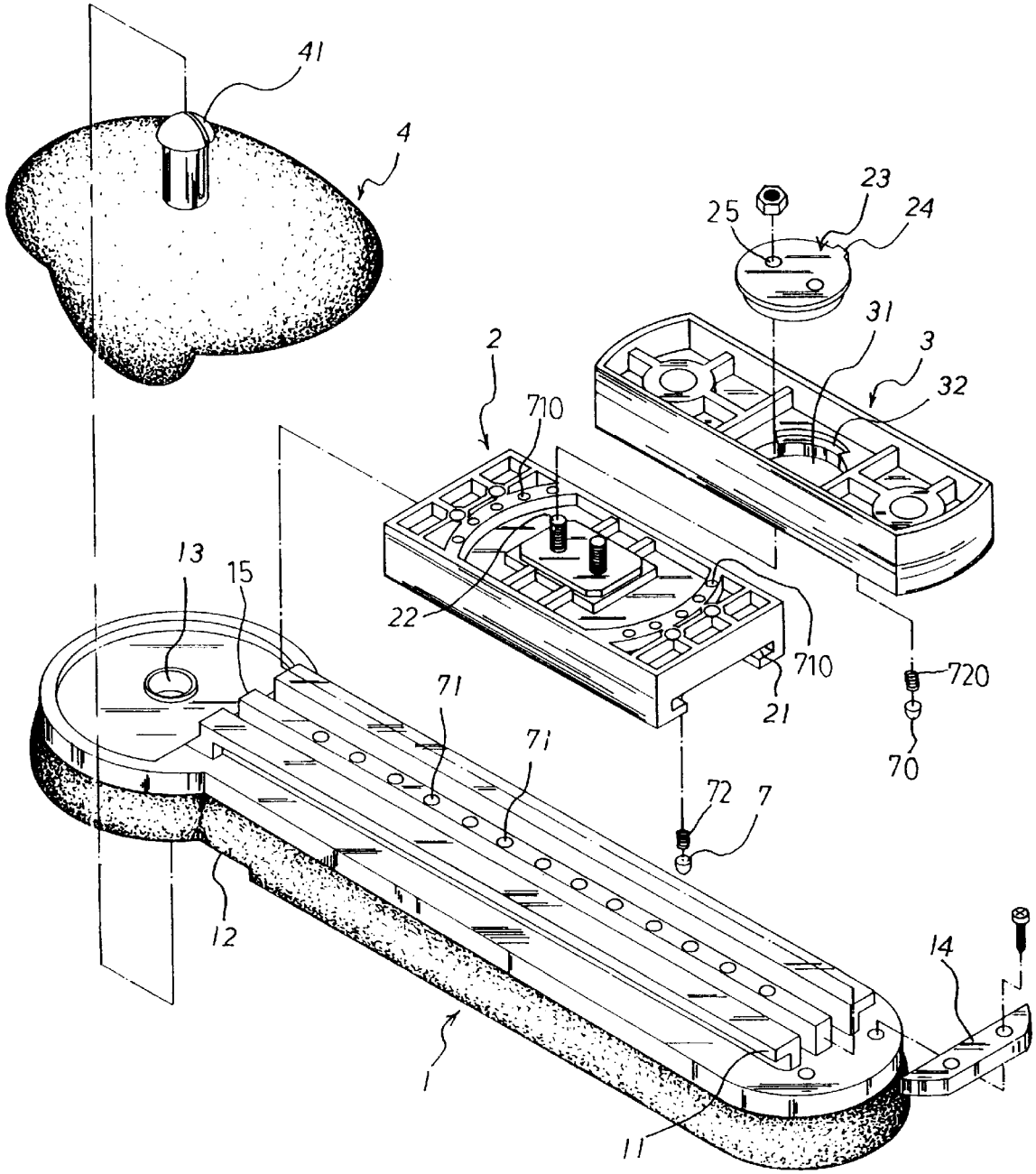
FIG. 1 is a perspective exploded view of an adjustable armrest device of a preferred embodiment in accordance with the present invention.
Figure 2:
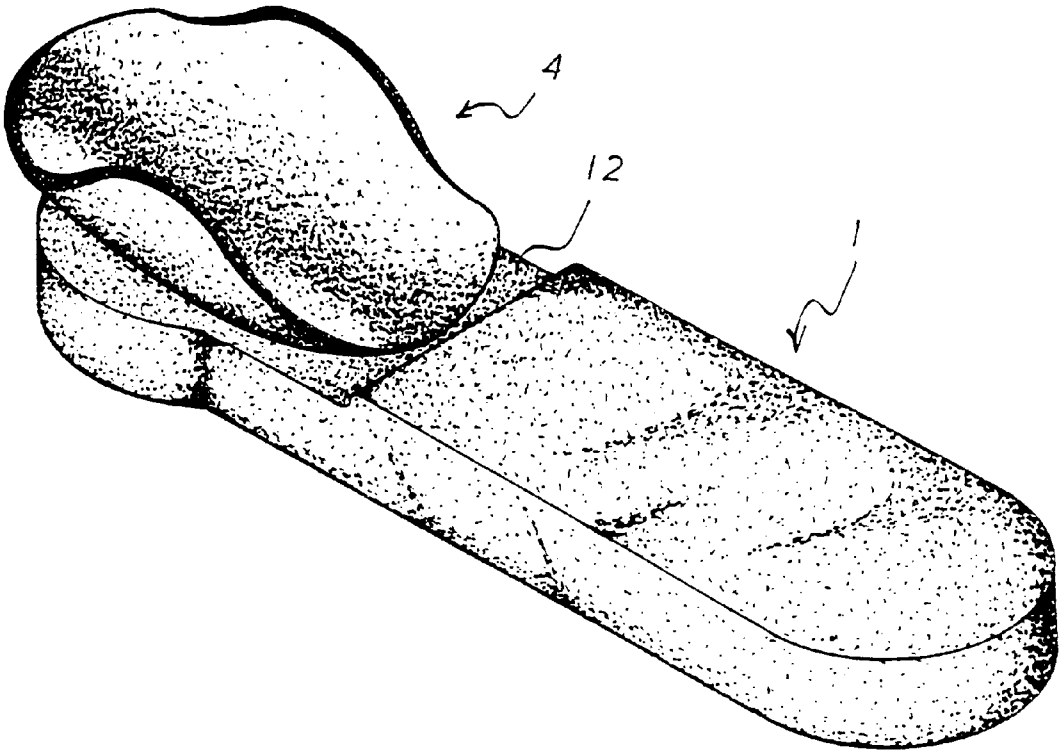
FIG. 2 is a perspective assembly view of an adjustable armrest device of a preferred embodiment in accordance with the present invention.
Figure 3:
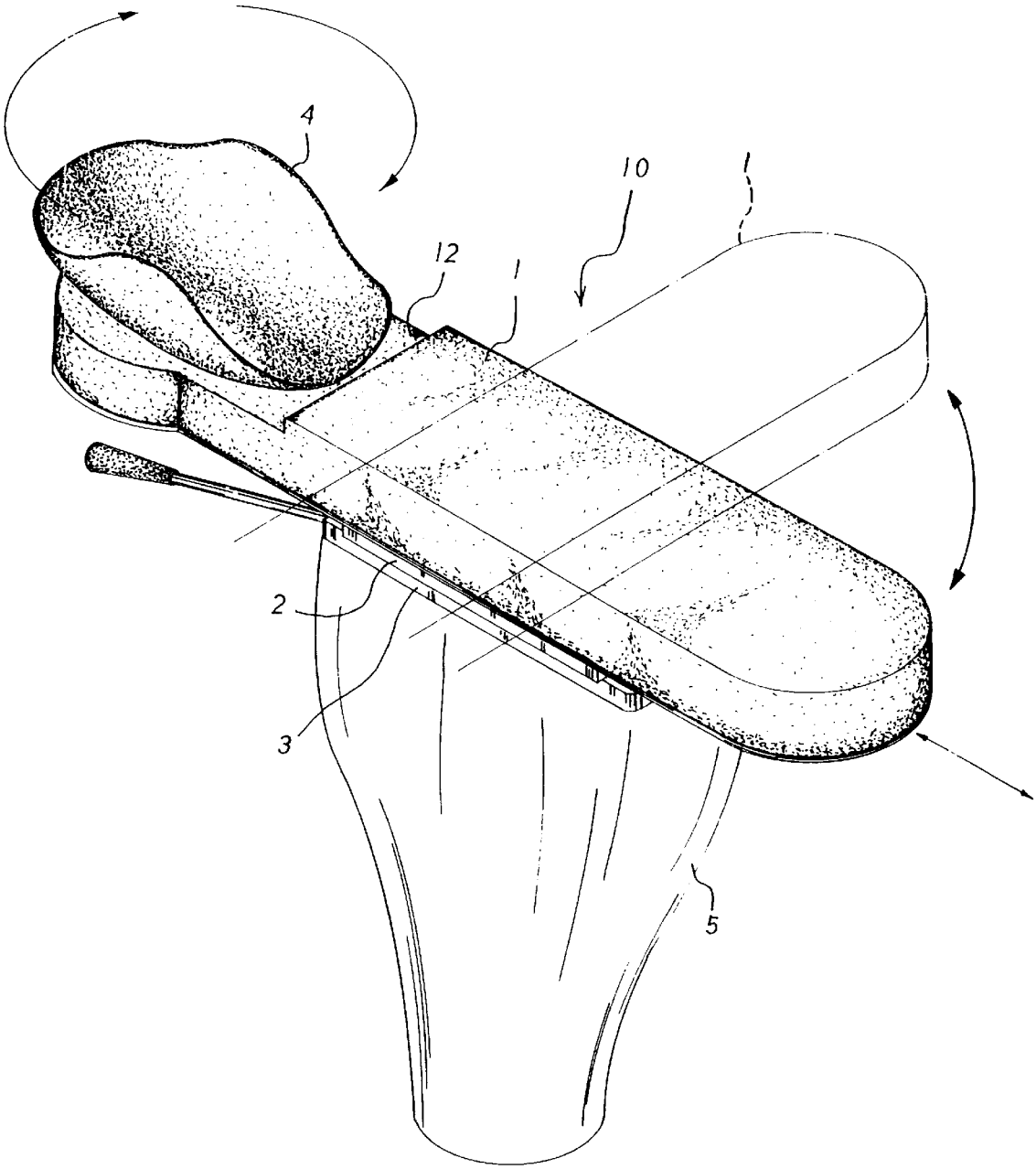
FIG. 3 is a schematic view illustrating an operation of an adjustable armrest device of a preferred embodiment in accordance with the present invention.

Referring to FIGS. 1 to 3, an adjustable armrest device comprises an armrest seat 1, a slide seat 2 disposed on the armrest seat 1, and a pivot connection seat 3 disposed on the slide seat 2.

The armrest seat 1 has a recess portion 12, a circular hole 13, a center bar 15, and two rails 11.

A plurality of recess holes 71 are formed on the center bar 15.

A blocking plate 14 is fastened on the armrest seat 1.

The slide seat 2 has two guide grooves 21 engaging with the rails 11.

A plurality of blind holes 710 are formed on the slide seat 2.

The pivot connection seat 3 has a center hole 31 and a camber recess 32 communicating with the center hole 31.

A disk 23 is inserted in the center hole 31 of the pivot connection seat 3. The disk 23 has two through holes 25 and a protruded block 24 engaging with the camber recess 32.

Two screw rods 22 are disposed on the slide seat 2 and inserted in the through holes 25 of the disk 23.

The pivot connection seat 3 is disposed on an armrest holder 5 stably.

A pad 4 is disposed on the recess portion 12 of the armrest seat 1. A pivot post 41 is inserted through the pad 4 and inserted in the circular hole 13. The pad 4 can be rotated.

A coiled spring 72 and a first ball 7 are disposed between the armrest seat 1 and the slide seat 2. The first ball 7 is inserted in one of the recess holes 71.

When the armrest seat 1 moves along the slide seat 2, the first ball 7 can be inserted from one recess hole 71 into another recess hole 71.

Therefore, the armrest seat 1 can be moved.

A compression spring 720 and a second ball 70 are disposed between the pivot connection seat 3 and the slide seat 2. The second ball 70 is inserted in one of the blind holes 710.

When the slide seat 2 rotates, the second ball 70 can be inserted from one blind hole 710 into another blind hole 710.

Therefore, the armrest seat 1 and the slide seat 2 are rotated simultaneously.

Figure 4:
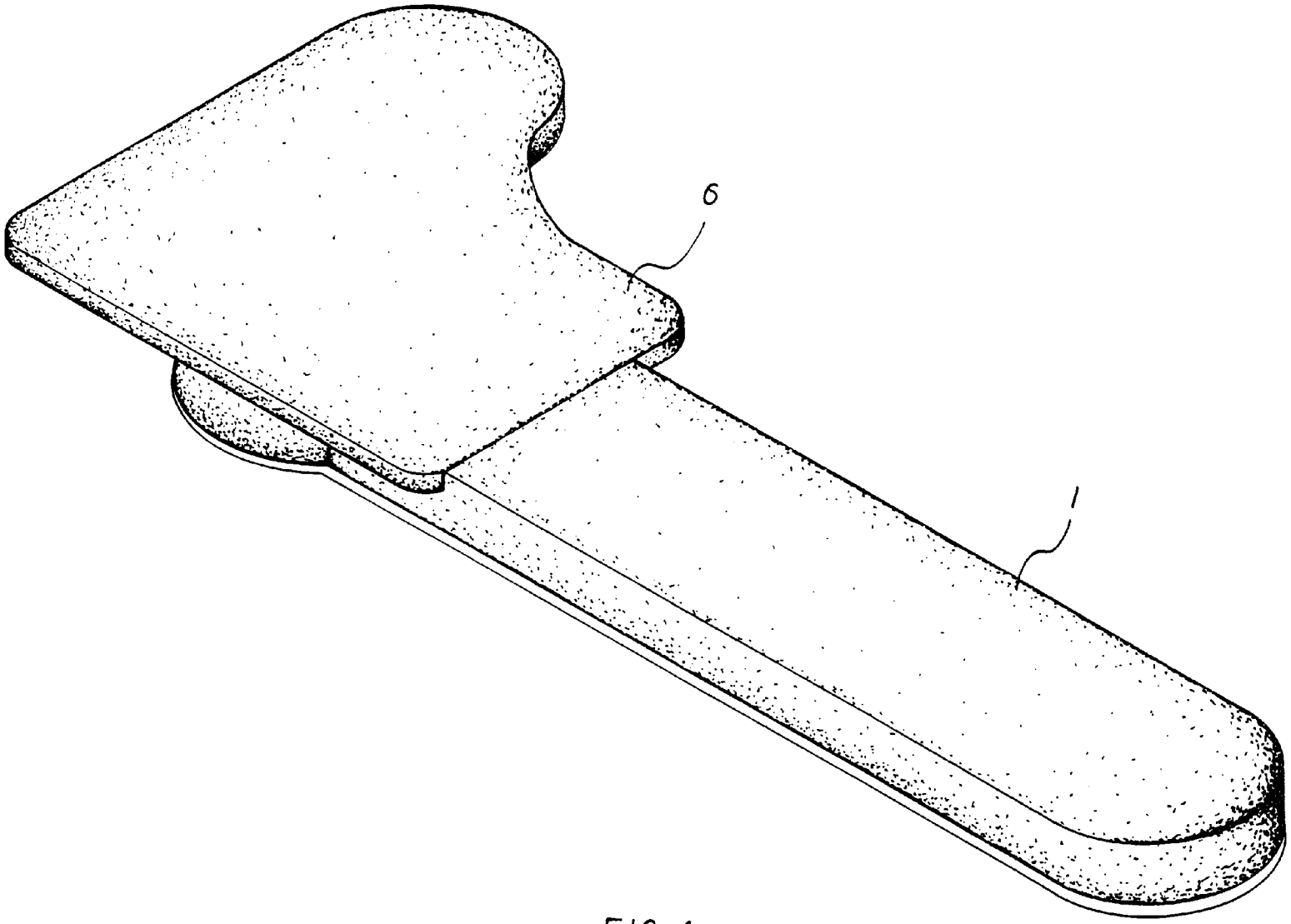
FIG. 4 is a perspective assembly view of a mouse plate disposed on an adjustable armrest device.

Referring to FIG. 4, a mouse plate 6 replaces the pad 4. The mouse plate 6 is disposed on the armrest seat 1.

Figure 5:
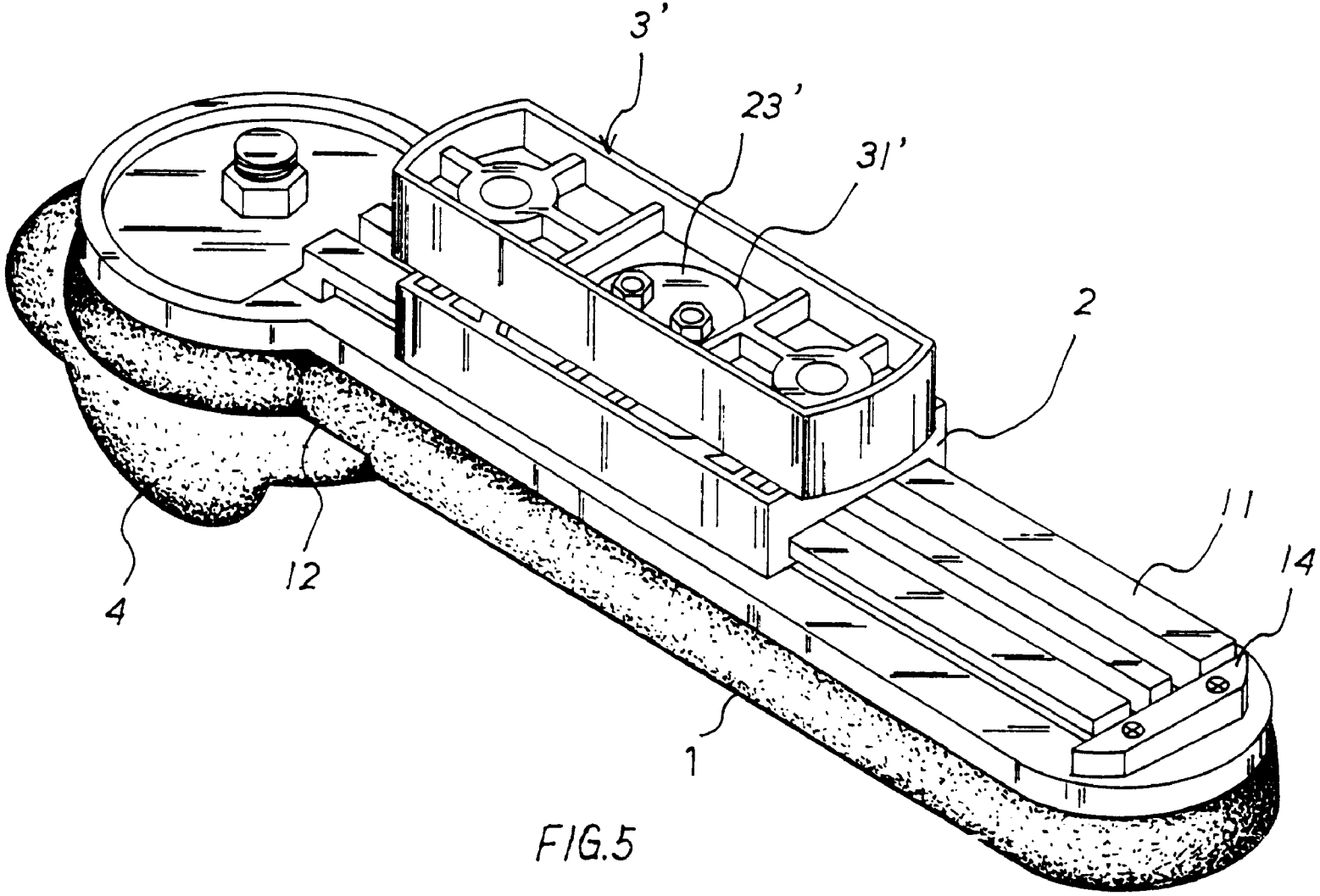
FIG. 5 is a perspective assembly view of an adjustable armrest device of another preferred embodiment in accordance with the present invention.
Figure 6:
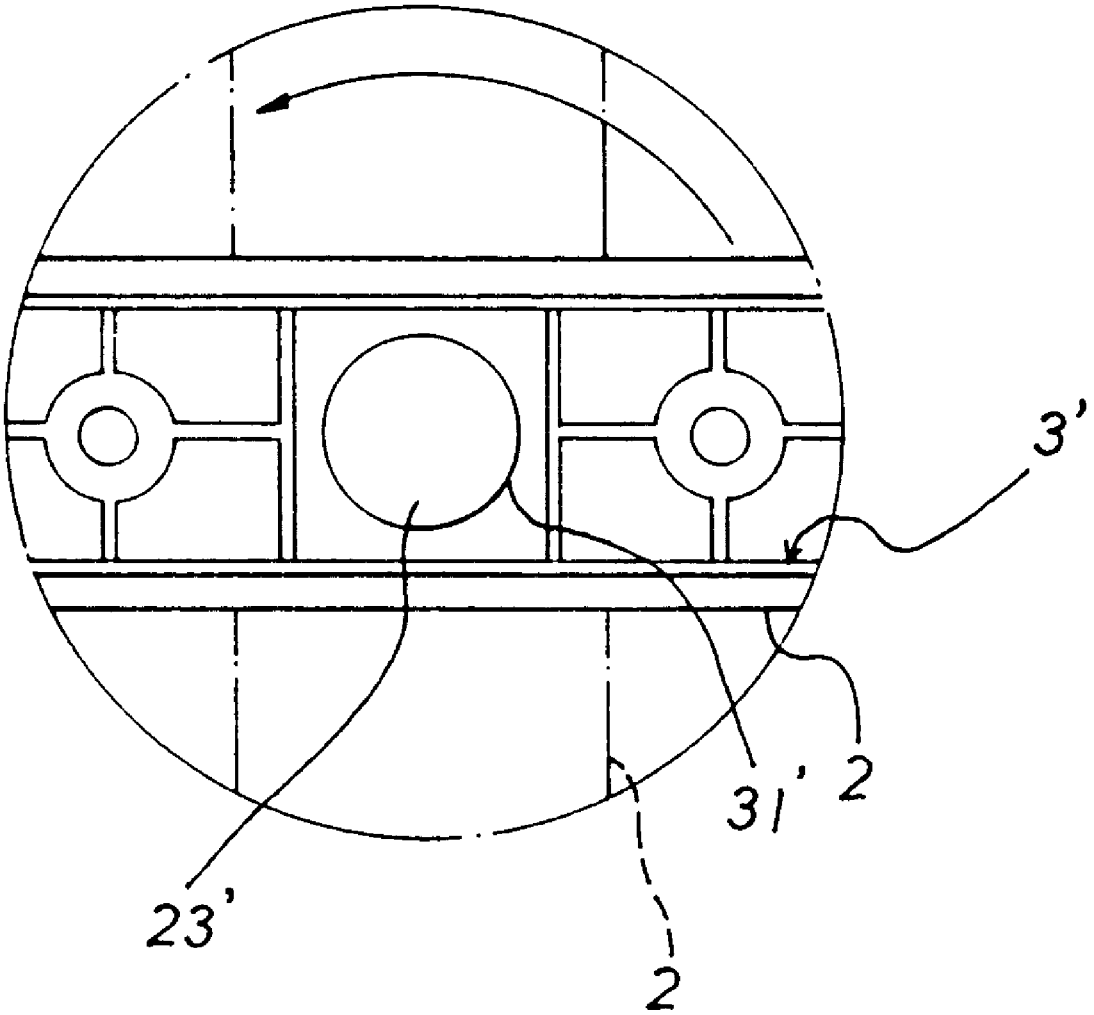
FIG. 6 is a schematic view illustrating an engagement of a slide seat and a pivot connection seat of an adjustable armrest device of another preferred embodiment in accordance with the present invention.

Referring to FIGS. 5 and 6, another pivot connection seat 3' comprises a round center hole 31'. Another disk 23' is in a round shape. The disk 23' is inserted in the round center hole 31'.

The present invention is not limited to the above embodiment but various modification thereof may be made. Furthermore, various changes in form and detail may be made without departing from the scope of the present invention.

I claim:

1. An adjustable armrest device comprising:

an armrest seat, a slide seat disposed on the armrest seat, and a pivot connection seat disposed on the slide seat, the armrest seat having a recess portion located on a front bottom of the armrest seat, a circular hole formed on a front portion of the armrest seat, a center bar disposed on a center of the armrest seat transversely, and two rails disposed on the armrest seat transversely, a plurality of recess holes formed on the center bar, a blocking plate disposed on a rear portion of the armrest seat and fastened on the armrest seat, the slide seat having two guide grooves engaging with the rails, a plurality of blind holes formed on the slide seat in two rows, the pivot connection seat having a center hole, a disk inserted in the center hole of the pivot connection seat, the disk having two through holes, and two screw rods disposed on the slide seat to match the through holes of the disk and inserted in the through holes of the disk.

2. The adjustable armrest device as claimed in claim 1, wherein a pad is disposed on the armrest seat.

3. The adjustable armrest device as claimed in claim 1, wherein a mouse plate is disposed on the armrest seat.

* * * * *